US012589965B2

(12) United States Patent
Morrison

(10) Patent No.: US 12,589,965 B2
(45) Date of Patent: Mar. 31, 2026

(54) MOBILE REEL CARRIER

(71) Applicant: Gary Morrison, South Point, OH (US)

(72) Inventor: Gary Morrison, South Point, OH (US)

( * ) Notice: Subject to any disclaimer, the term of this patent is extended or adjusted under 35 U.S.C. 154(b) by 80 days.

(21) Appl. No.: 18/244,286

(22) Filed: Sep. 10, 2023

(65) Prior Publication Data

US 2025/0083916 A1 Mar. 13, 2025

Related U.S. Application Data

(63) Continuation-in-part of application No. 17/117,221, filed on Dec. 10, 2020, now Pat. No. 11,753,272.

(51) Int. Cl.
*B65H 75/40* (2006.01)
*B65H 18/02* (2006.01)
*B65H 19/30* (2006.01)

(52) U.S. Cl.
CPC ..... *B65H 18/028* (2013.01); *B65H 19/30* (2013.01); *B65H 2301/41369* (2013.01)

(58) Field of Classification Search
CPC ..... B65H 18/02; B65H 18/028; B65H 19/30; B65H 75/40; B65H 75/403; B65H 75/4407; B65H 75/4471; B65H 75/4486; B65H 2701/33; B65H 2701/533
See application file for complete search history.

(56) References Cited

U.S. PATENT DOCUMENTS 7,461,807 B2 * 12/2008 Mosher ..... B65H 75/40 242/532.5
2004/0021030 A1 * 2/2004 Brocking ..... B65H 75/4471 242/395
2004/0231723 A1 * 11/2004 Harrington ..... A01G 25/162 137/355.2
2005/0103918 A1 * 5/2005 Bedwell ..... B65H 75/4486 242/395
2015/0298936 A1 * 10/2015 Haldorsen ..... B65H 75/4402 242/397.3
2017/0248488 A1 * 8/2017 Chevrier ..... G01M 1/326
2020/0095088 A1 * 3/2020 Kierath ..... B65H 75/4486

* cited by examiner

*Primary Examiner* — Sang K Kim
(74) *Attorney, Agent, or Firm* — YORK LAW LLC; Olen L. York, III

(57) ABSTRACT

A reel carrier that includes a pallet having a platform bound by a frame and a shaft. The carrier includes a reel that is supported on the shaft. The reel includes a round drum rotatable about the shaft, wherein the rotation may be in a forward and/or a reverse or backward rotational direction. The carrier also includes a motor operably coupled to cause rotation of the drum and may be further operably coupled to cause deployment and/or retraction of one or more wheels included with the pallet, wherein the motor also controls locomotion of the one or more wheels.

17 Claims, 8 Drawing Sheets

MOBILE REEL CARRIER

I. RELATED APPLICATIONS

This application is a continuation-in-part of U.S. patent application Ser. No. 17/117,221 filed on Dec. 10, 2020, which is now U.S. Pat. No. 11,753,272 issued on Sep. 12, 2023, and which claims the benefit of U.S. Provisional Application No. 62/946,354, filed on Dec. 10, 2019.

II. FIELD OF THE INVENTION

This application discloses claims and embodiments a mobile reel carrier for on-loading and off-loading rolled product to and from a drum or spool containing rolled product(s).

III. BACKGROUND OF THE INVENTION

Many apparatuses, systems, and methods have been and are offered to address winding and/or dispensing rolled products, such as bare and/or insulated wire and/or cable. These apparatuses, systems, and methods include a non-exhaustive recitation of varied articles, such as reels having an intermediate spool disposed between end flanges, stationary reel racks, mobile reel caddies that are manually manipulated and positioned, reel elevation mechanisms for dispensing product, manually operated wire or cable metering devices, stationary and/or portable payout stands.

However, each category of dispenser identified above generally suffers from at least one drawback, such as the need for manually mounting the drum(s) or spool(s) and thereafter manually manipulating the device to achieve payout of the product. Such manual payout is complicated with the concern of navigating uneven and/or soft terrain. Because of the manual manipulation of these various options, one or more individuals are exposed to a variety of injury risks because of the weight, angle of positioning, terrain, and other related hazard-inducing concerns.

More particularly, wood reels are usually large and extremely heavy. Manual positioning of such wood reels, especially with rolled products (e.g., cable and/or wire) placed thereon, proves very difficult for one or more individuals. Individuals have difficulty moving such large reels, which can measure between several hundred pounds to nearly 15,000 pounds in extreme instances. Utilizing more than one individual to move such reels, despite improving the likelihood and relative ease of moving the reel, the addition of other individuals instead introduces increased likelihood of injury risk, and depending upon the dimension of the reel, may prove to be inefficient and equally as difficult without any improvement in moving the reel and doing so safely.

Accordingly, there is an ongoing need for an apparatus, system, and/or method that provides improved safety and injury risk-mitigation for individuals tasked with on-loading and/or off-loading rolled products from such drums or spools.

IV. SUMMARY OF THE INVENTION

In one embodiment, a reel carrier for a rolled product, the reel carrier comprises a pallet having a platform bound by a frame, the pallet supporting a shaft rotatable in a forward and reverse direction, the pallet having at least one sidewall upwardly depending from the frame, a reel supported on the shaft and rotatable about the shaft in a forward and a reverse direction, the reel configured to take-up the rolled product thereon to subsequently pay-off the rolled product from the top-side of the reel in an over-the-top delivery to optimize the structural integrity of the rolled product and minimize the structural stress of the rolled product, and a motor operably coupled to cause rotation of the shaft supporting the reel.

In another embodiment, a reel carrier for a rolled product, the reel carrier comprises a pallet having a platform bound by a frame, the pallet supporting a shaft rotatable in a forward and reverse direction, the pallet having at least one sidewall upwardly depending from the frame, a reel supported on the shaft and rotatable about the shaft in a forward and a reverse direction, the reel configured to take-up the rolled product thereon to subsequently pay-off the rolled product from the top-side of the reel in an over-the-top delivery to optimize the structural integrity of the rolled product and minimize the structural stress of the rolled product, a motor operably coupled to cause rotation of the shaft supporting the reel, and a charging system for recharging one or more batteries operatively coupled to the motor.

The carrier further comprises a control panel operably coupled with the motor.

The carrier further comprises a plurality of wheels depending from the pallet.

The carrier wherein the motor is operably coupled to at least one of the plurality of wheels via wheel articulation means.

The carrier further comprises a second small inner reel.

The carrier further comprises a window formed in the at least one sidewall.

The carrier further comprises a canopy, wherein the canopy complements the at least one sidewall and defines an enclosure for the reel supported on the shaft.

The carrier further comprises a tracking system.

The carrier further comprises an adjustable step depending from the platform.

The carrier further comprises a leveling armature for winding rolled product.

The carrier further comprises an inline measure device for measuring the rolled product.

V. BRIEF DESCRIPTION OF THE DRAWING(S)

The advantages and features of the present invention will become better understood with reference to the following more detailed description and claims taken in conjunction with the accompanying drawings, in which like elements are identified with like symbols, and in which:

Figure 4A:
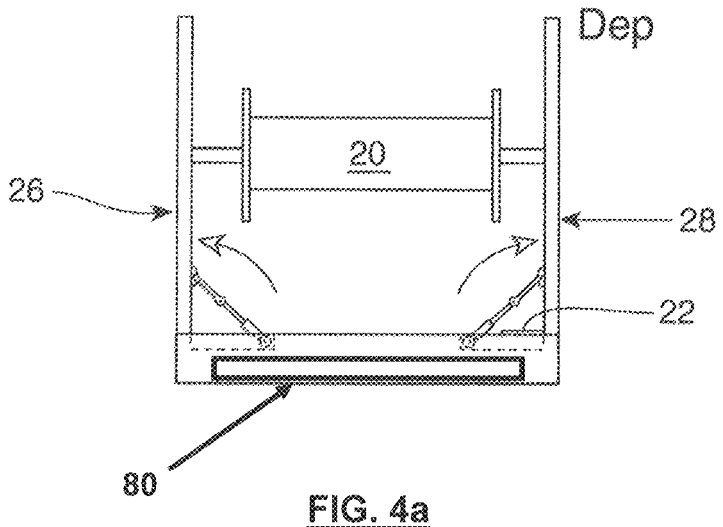
Figure 4B:
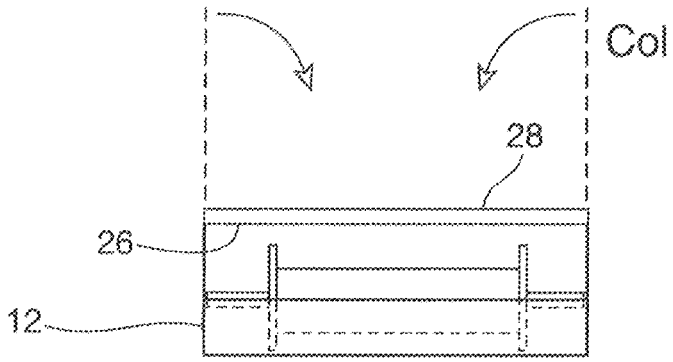
Figure 5A:
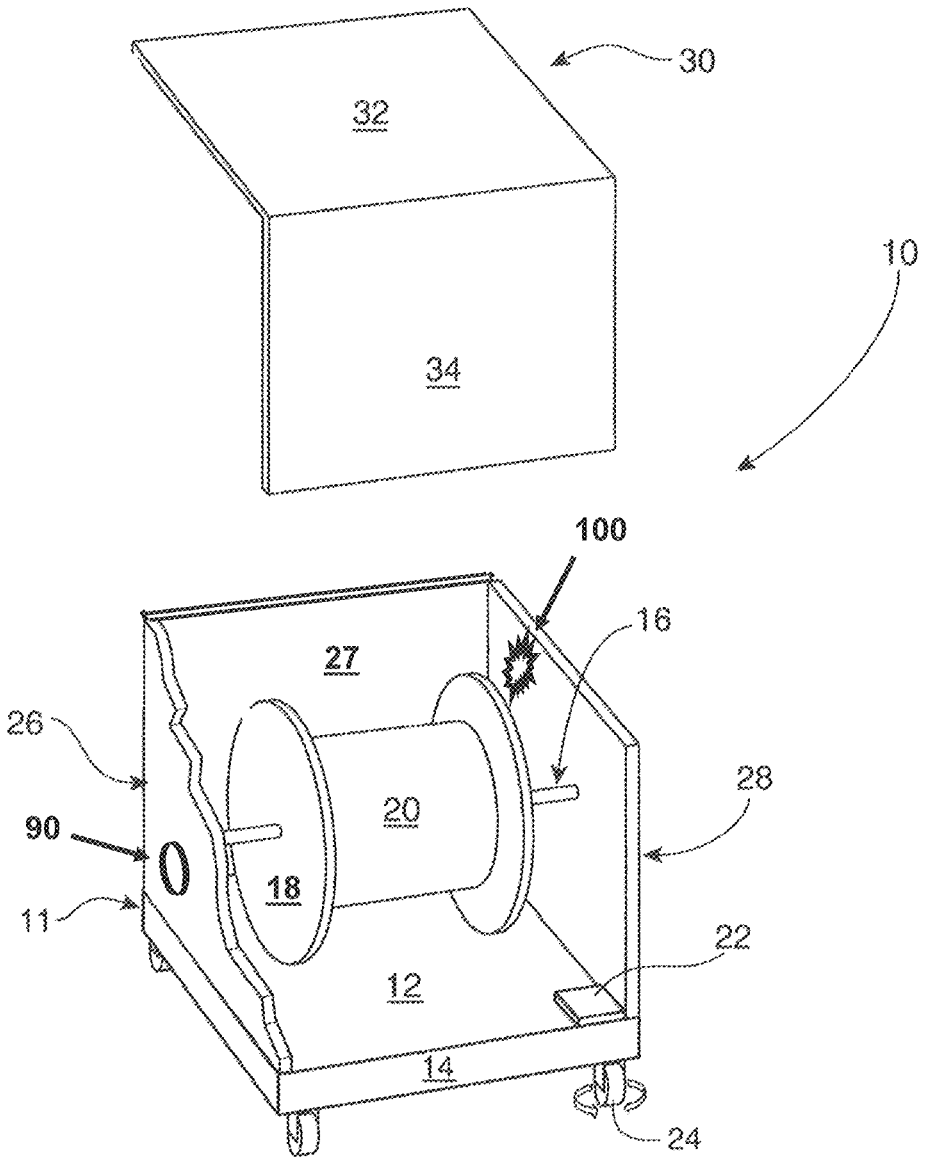
Figure 5B:
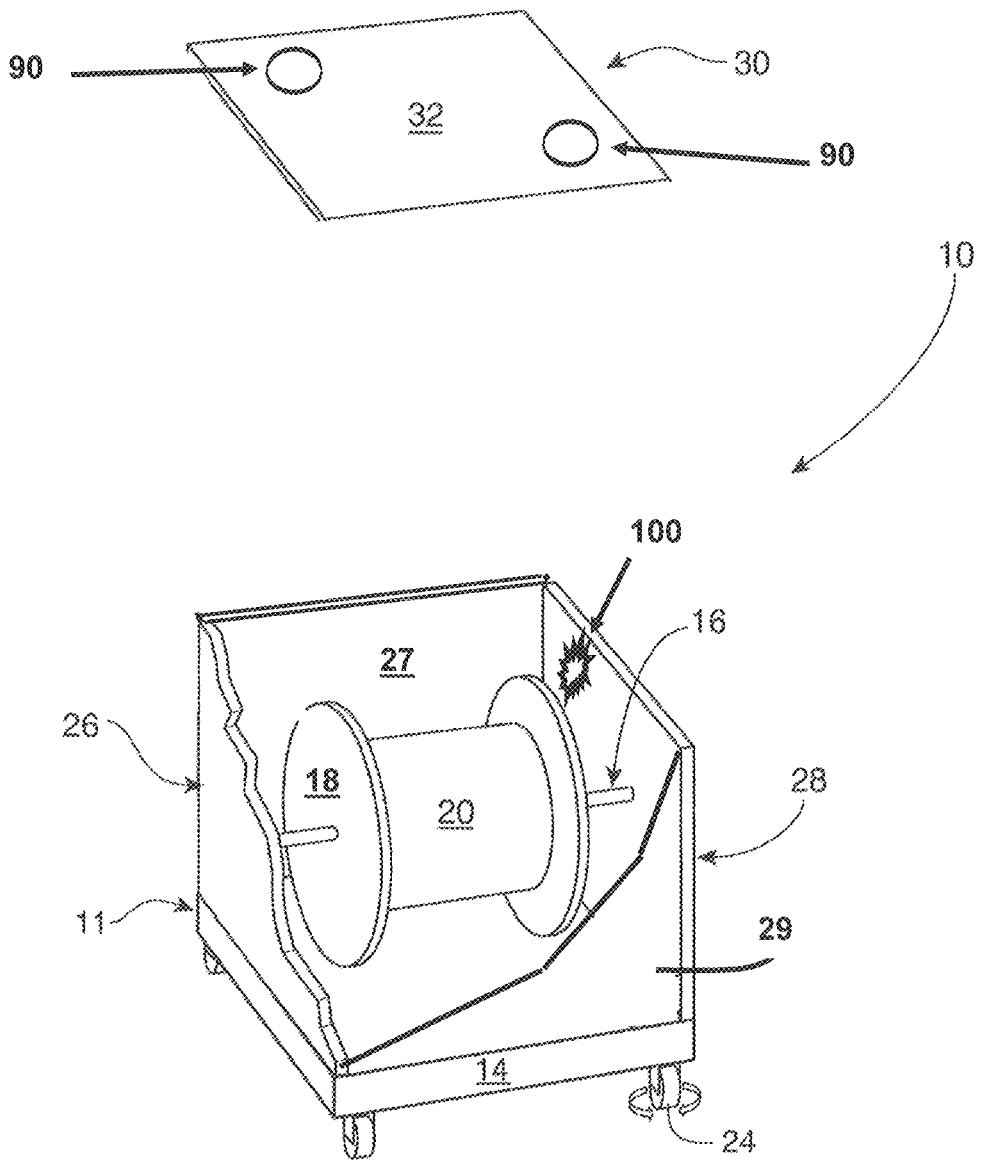
Figure 6:
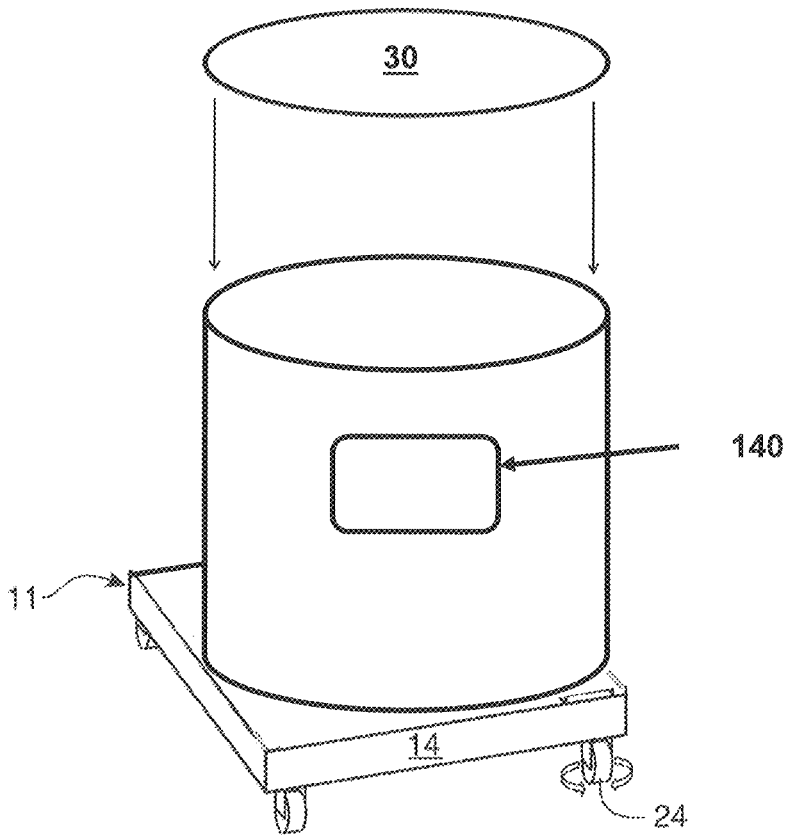
Figure 7A:
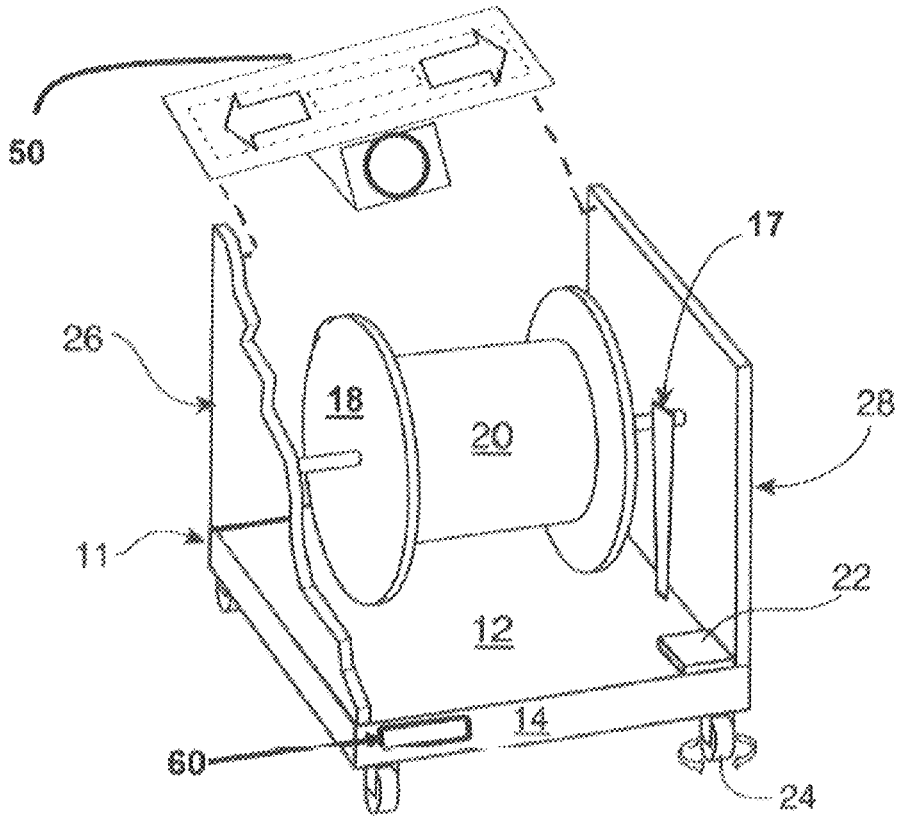
Figure 7B:
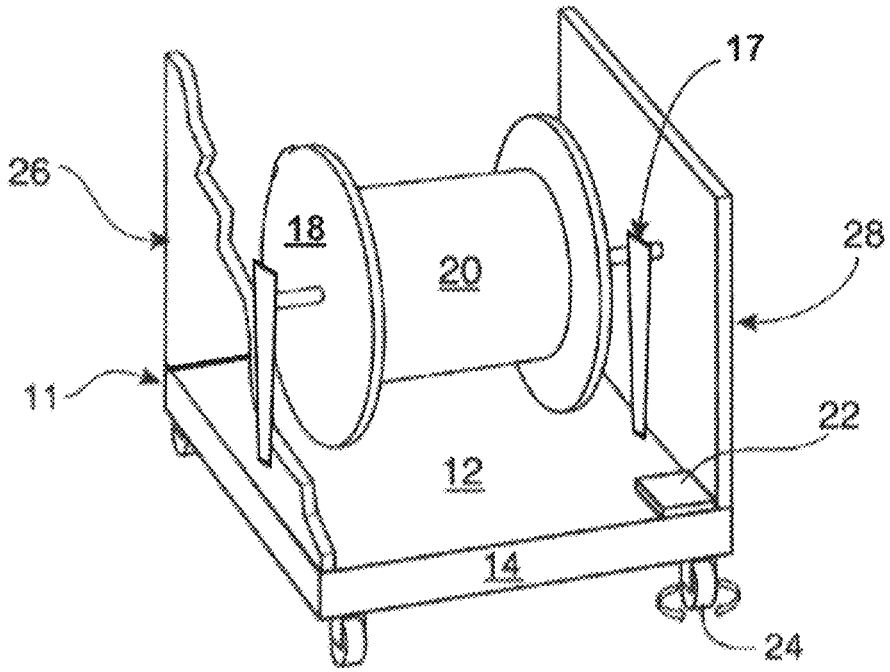

FIG. 4*a* is a front view of the pallet with the sidewalls deployed (Dep);

FIG. 4*b* is a front view of the pallet with the sidewalls collapsed (Col);

FIG. 5*a* is a perspective view of the real carrier apparatus having three sidewalls;

FIG. 5*b* is a perspective view of the real carrier apparatus having four sidewalls;

FIG. 6 is a perspective view of the real carrier apparatus having a prolate form;

FIG. 7*a* is perspective view of the real carrier apparatus having a single leg supporting the shaft and reel; and FIG. 7*b* is perspective view of the real carrier apparatus having two legs supporting the shaft and reel

VI. DETAILED DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

In accordance with the drawings illustrating at least one embodiment, as generally depicted in FIG. 1 through FIGS. 7*a* and 7*b*, a reel carrier apparatus 10 comprises a pallet 11 having a platform 12 bound by a frame 14. The pallet 11 has a shaft 16 that supports a reel 18. The reel 18 has a round drum 20 rotatable about the shaft 16 in a forward and a backward direction. The carrier 10 also includes a motor 22 operably coupled to independently control forward or backward rotation of the shaft 16 or the drum 20, with the motor 22 capable of separate engagement of the shaft 16 and the drum 20 to effectuate take-up and/or pay-off, and with the motor 22 capable of concurrent, but separate engagement of the shaft 16 and drum 20.

It is envisioned that the pallet 11 may further comprise a plurality of wheels 24 depending therefrom and providing the appropriate elevation of the pallet 11 relative to the surface(s) upon which the carrier 10 may travel. In one embodiment, the plurality of wheels 24 is retractable relative to a frame 14 of the pallet 11. In another embodiment, the plurality of wheels 24 is retractable within the frame 14 of the pallet 11. In another embodiment, the plurality of wheels 24 is retractable without the frame 14 of the pallet 11. In another embodiment, the plurality of wheels 24 is retractable as a combination within and without the frame 14 of the pallet 11.

The pallet 11 has a platform 12 that has an exterior surface and an interior surface, with a thickness defining the separation between the exterior surface and the interior surface. The pallet 11 includes a frame 14 bounding the perimeter of the exterior and interior surfaces defining the platform 12. In general, the pallet 11 has an orthogonal configuration, whether as a square or rectangular shape. However, it is further envisioned that the pallet 11 (and its constituent elements described herewith) may also have a disk, ovoid, or other polygonal shape. Regardless of pallet 11 shape, the pallet 11 and its constituent parts may be manufactured from a durable material, such as metal, alloys, plastic, or similarly durable materials, and combinations of these materials, and thereby avoiding utilization or over-reliance on resources difficult to renew (such as wood or wood-like products often used for both pallets and reels that are then-used for shipping and/or storage purposes).

It is envisioned that the shaft 16 (and thus the reel 18 and drum 20) may be supported in a variety of ways. For example, consistent with FIGS. 1 through 3 and discussed below, the shaft 16 may be supported by a pair of sidewalls 26, 28 that are disposed in a variety of orientations. In an alternative embodiment, consistent with FIG. 7*a*, the shaft 16 (with reel 18 and drum 20) are supported by at least one leg 17 upwardly depending from the pallet 11. FIG. 7*b* represents an embodiment with at least two legs 17 upwardly depending from the pallet 11 and supporting the shaft 16. In one embodiment, the leg or legs 17 may be used to seat a reel and/or drum that is not part of the integrated apparatus 10 and system as described. In such an embodiment, for example, a wooden reel and/or drum with rolled product may be positioned on the leg(s) 17 to support the wooden reel and/or drum and to turn the wooden reel/drum forward or reverse to on-load or pay-off the rolled product.

It is envisioned that the reel 18 and/or drum 20, and in additional embodiments both the reel 18 and drum 20, may be configured so that the orientation of the reel 18 and/or drum 20 prevents take-up and pay-off from occurring in a manner that places distress on the rolled product. For example, it is envisioned that the reel 18 and/or drum 20 may be configured and oriented to inhibit the rolled product from paying-off via the underside of the reel 18 and/or drum 20, or from a counterclockwise rotation of the reel 18 and/or drum 20 when viewed from the right-side of the carrier 10 (with the sidewall 26 immediately adjacent this perspective) or from a clockwise rotation of the reel 18 and/or drum 20 when viewed from the left-side of the carrier 10 (with the sidewall 28 immediately adjacent this perspective). Paying-off rolled products from the underside of the reel, drum, or spool places tremendous physical strain and stress on the product and damages the product causing short-term inefficiencies and shortened life-span of the product, increasing costs for the end-user. By comparison, paying-off rolled products from the topside (over-the-top) of the reel, drum, or spool optimizes the structural integrity of the rolled product and minimizes the stress and strain placed on the rolled-product during delivery and installation.

Figure 1:
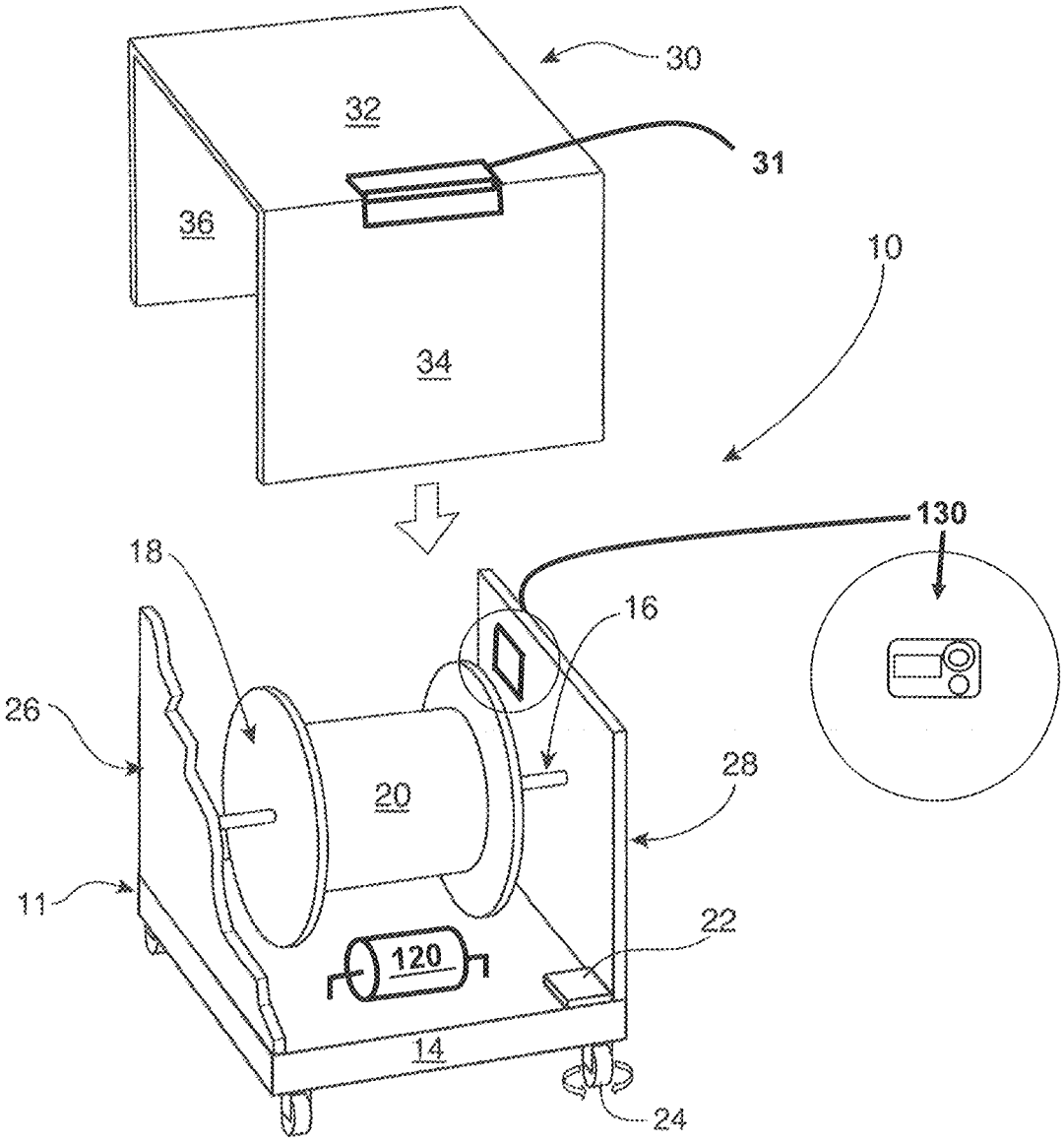
FIG. 1 is a perspective view of a reel carrier apparatus.

Optionally, consistent with FIG. 1, a measuring device 130 is included to assist in verifying the length of the rolled product that is on-loaded or payed-off. Preferably, the measuring device 130 is an inline wire measuring device that measures and confirms the length of the rolled product. Preferably, the measuring device 130 will include a readout or other means for appreciating the precision measurement.

Consistent with FIG. 7*a*, it is also envisioned that the system may include an armature 50 for winding cable and/or wire in a level manner. Consistent loading and unloading of cable and/or wire, in which the cable/wire is evenly distributed across a reel and/or drum prevents damage and degradation to the product. Accordingly, an armature 50 to ensure level winding and unwinding of the rolled product increases the likelihood of product delivery that is satisfactory and minimizes the opportunity for damage. The armature 50 may be integral to the pallet 11 through support of the same or similar structure used for supporting the shaft 16. Likewise, the armature 50 may be non-integral and disposed in a manner to cooperatively communicate with the rotating shaft 16, reel 18, and/or drum 20.

Consistent with FIG. 7*a*, it is also envisioned that the apparatus 10 and system may include a level 60. The level 60 may be integral or separate from the apparatus 10 and system. In particular, the level 60 is envisioned as providing alignment so that on-load and pay-off of the rolled product promotes even distribution across the shaft 16, reel 18, and/or drum 20. The level 60 may have a variety of configurations and dispositions, including the use of mechanical levels (including bubble-type levels), electronic/digital levels that may use GPS or other types of digital and satellite technologies, and combinations of these forms of levels.

Figure 2:
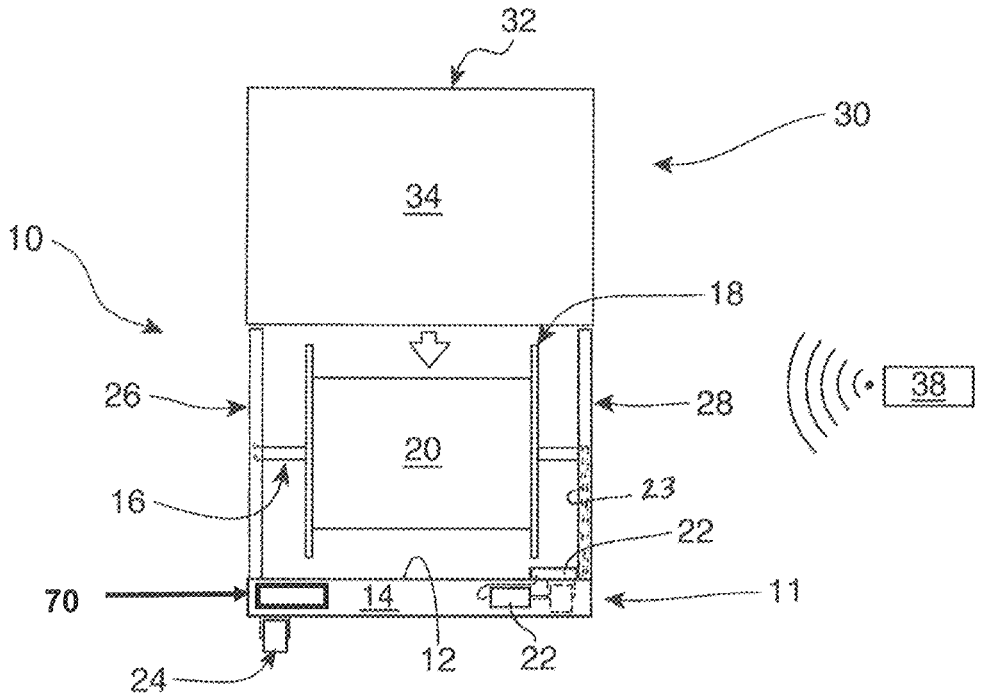
FIG. 2 is a front view of FIG. 1 with the wheels retracted.

The motor 22 may comprise a variety of configurations, including combinations of known components. For example, the motor 22 may be supplied energy via a standard fossil-fuel utilizing source (e.g., gasoline, diesel, and/or propane powered motors). In another example, the motor 22 may be supplied energy via electrical energy stored in some sufficient manner, whether by battery, capacitor, and/or utilization of electrical sources (including high-voltage electrical outlets). Energy storage, whether by batter, capacitor, and/or combinations thereof are preferably constructed of heavy duty material so that all the motor(s) and motor component(s) and other electrical devices are powered for long durations and with consistent results. Optionally, as seen in FIG. 2, in conjunction with the use of battery(ies) and/or capacitor(s), the apparatus 10 and/or system may include a charging system 70. Preferably, the charging system 70 comprises an alternating current (AC).

The motor 22 is envisioned to control the forward and reverse rotational direction of the shaft 16, reel 18, and/or drum 20. This control may be achieved through a number of possible means, including motorized, automated rotation of the shaft 16, the reel 18, and/or the drum 20 (as depicted in FIG. 2 via drive or chain 23). In an embodiment in which one or more legs 17 support the shaft 16 (FIGS. 7*a* and 7*b*), the motor 22 independently controls the rotation of the shaft 16 apart from any control/influence over the leg(s) 17.

Moreover, it is envisioned that the motor 22 controls the locomotion of the carrier 10 via one or more wheels 24, whereby the motor 22 automates and controls the direction of at least one wheel 24. It is further envisioned that the motor 22 may control at least two wheels 24, at least three wheels 24, at least four wheels 24, and includes the possibility of control all wheels 24 provided. Moreover, it is further envisioned that the motor 22 additional controls the direction of each wheel 24 during locomotion to move the carrier 10.

Various wheel articulation means may be utilized for deploying and retracting the plurality of wheels 24. For example, each wheel 24 may be configured to include a pivot with a locking mechanism to secure the wheel 24 in a deployed or retracted manner. Similarly, each wheel 24 may be configured to include a reciprocating post for deploying or retracting the wheel 24 between retracted and deployed positions. The wheels 24 may be deployed and retracted using manual or automated means, including manual manipulation of pivots and posts or automated manipulation utilizing hydraulic, pneumatic, mechanical, or other similar means, and/or combinations thereof. It is further envisioned that the motor 22 also controls the locomotion of the carrier 10 apparatus via steering means, wherein the motor 22 controls the deployment of one or more wheels 24 and the locomotion of the wheels 24 and the carrier 10 supported thereby.

Control of the wheels 24 and other elements of the apparatus 10 and/or system may be achieved via a steering mechanism. Alternatives may include a round steering wheel, half-moon steering wheel, and other versions of a steering wheel. Additional alternatives may include one or more handle bars, zero turn handles, or any other steering mechanism with similar types of linkages. Additional alternatives may include a variety of joystick and/or controller type mechanisms, including single, omnidirectional joysticks controls, toggle controls, and omnidirectional rotary controls.

In relation to the control of various moving elements of the apparatus 10 and/or system, consistent with FIG. 1, it is envisioned that the apparatus 10 and/or system may include a step or stage/podium 80 for the user to utilize. The step/stage/podium 80 provides an elevation off the ground that places the user at or near the level of the apparatus 10 for moving the apparatus 10 from one location to another. The step/stage/podium 80 elevates the user out of potential contact with the apparatus 10 that may result in injury or temporary or permanent impairment. Preferably, the step/stage/podium 80 is adjustable along both the vertical and horizontal, so that specified height(s) and/or specified locations about the apparatus 10 may be achieved.

With the various controls utilized, including forward and reverse motors for controlling the reel 18, the steering and articulation of the wheels 24, and other such controls, it is preferable to include one or more braking 110 controls for each of the elements. For example, a brake 110 may be used for slowing and/or stopping the advance of the reel 18 in the forward or rearward direction. Likewise, a brake 110 may be used for slowing and/or stopping the advance of the apparatus 10, including the slowing or stopping of one or more wheels 24.

Consistent with FIG. 1, the apparatus 10 may further include a smaller inner reel 120. The small inner reel 120 may be utilized for a variety of jobs. In particular, the small inner reel 120 may be used for string and pull ropes that are often necessary for pulling wire through various conduits that are hard to navigate. By having the small inner reel 120 and the string and pull ropes at the beginning, three steps become a single step.

It is envisioned that the pallet 11 may further comprise one or more sidewalls for enclosing the shaft 16, reel 18, and drum 20. As depicted in FIG. 6, the pallet 11 may comprise a sidewall 25 having a generally uniform configuration that may take the form of an egg, a barrel, or other similarly structured prolate shape. As depicted in FIGS. 1 through 4*b*, the pallet 11 may comprise a first sidewall 26 and a second sidewall 28, each one of the sidewalls 26, 28 upwardly depending from the frame 14 of the pallet 11. As depicted in FIG. 5*a* and FIG. 5*b*, the pallet 11 may comprise a first sidewall 26, a second sidewall 28, and alternatively a third sidewall 27, and additionally alternative a fourth sidewall 29. For each of the embodiments in which the pallet 11 includes one sidewall 25 or more than one sidewall 26, 28, and/or 27 and/or 29, it is envisioned that the shaft 16 may be supported by the sidewall(s) 25 or 26, 28 or alternatively separately supported by one or more legs 17. It is also envisioned that a single window 140 of shatter proof material may be provided as part of any wall or sidewall so that shipping labels or other visual means for identifying the enclosed product is provided as depicted in FIG. 6.

For each of the embodiments referenced, it is envisioned that the top of the shaft 16, reel 18, and drum 20 are not covered by the sidewall(s) 25 or 26, 28 and instead an opening remains wherein a canopy 30 is utilized to cover the opening. Preferably, the canopy 30 is disposed in a manner so that it covers and encloses any remaining openings left open by the sidewall configuration(s). The canopy 30 may be a single removable and attachable unit comprising one or more walls adapted for such configuration and usage. It is further envisioned as an alternative that the canopy 30 may be integral to the sidewall(s) as configured so that the canopy is slidingly movable between a utilized and non-utilized disposition.

In one embodiment in which one sidewall 25 is utilized to achieve an egg, barrel, or prolate shape enclosing the elements of the apparatus 10, it is envisioned that a single canopy 30 access is provided that is slidable or removable so that access to the shaft 16, reel 18, and drum 20 are achieved. In such a configuration, the canopy 30 may appear as a single panel door or wall that is movable either through manual control or automated control (via motor 22 and control panel 38. As previously noted, the sidewall 25 may support the shaft 16, or alternatively, one or more legs 17 may be utilized to support the shaft 16.

In another embodiment in which two sidewalls 26, 28 are utilized, typically, the front and rear of the elements of apparatus 10 are accessible, as is the top. Accordingly, a canopy 30 similar to that depicted in FIG. 1 is necessary for enclosing the entirety of the apparatus 10 when appropriate. However, it is envisioned that such a canopy 30 might include hinges 31 at each junction of adjacent walls so that the front of the canopy 30 might be moved to provide front access (and likewise, the rear of the canopy 30 might be moved to provide rear access) to the elements and allow for on-loading or pay-off of any cable or wire retained by the reel 18 and drum 20.

In one such embodiment, the first sidewall 26 and the second sidewall 28 are oriented in parallel to the general rotational direction of rotation of the drum 20 and are thereby oriented in parallel to one another (26 and 28). In such an orientation, therefore, the first sidewall 26 and the second sidewall 28 are mutually opposed to one another in substantially similar orientations.

In another embodiment, the first sidewall 26 and the second sidewall 28 are oriented in a non-parallel orientation to one another (26 and 28), such that the sidewalls 26, 28 may be independently angled relative to shaft 16, reel 18, and drum 20, as well as the pallet 11 and platform 12 thereon. In such orientations it is desirable that the support of and insertion with and/or through of the shaft 16 is such that alignment and balance of the shaft 16 traverses the sidewalls 26, 28 at tangential points along each that are substantially in mutual opposition with one another (26, 28).

Consistent with FIG. 4*a* and FIG. 4*b*, it is further envisioned that the sidewalls 26, 28 of pallet 11 are separately capable of positioning between a collapsed and deployed or retracted position, as indicated by directional arrows (Col to Dep) relative to the platform 12. Securing each sidewall 26, 28 in a collapsed and/or retracted or deployed position may be achieved by a number of means, including removable pins, snap-fit impingement, one or more hinges, channels, and the like. The flexible, multiple positioning of the sidewalls 26, 28 imparts additional capability by allowing the user/operator to conveniently store and/or stack one or more carriers 10 in a manner that optimizes transports of one or more carriers 10 to minimize movement and damage to the carrier 10, dead or under-utilized space within a transport, and other similar considerations.

The sidewalls 26, 28 include the shaft 16 that is intermediately disposed between the sidewalls 26, 28, with the shaft 16 so disposed to support the reel 18 (and drum 20) for rotation thereabout. The orientation of the sidewalls 26, 28 provides access via the front, top, and rear of the carrier 10. This access also accommodates a canopy 30 of complementary shape so that when the canopy 30 is placed into position, the canopy 30 and the sidewalls 26, 28 form an enclosure about the reel 18 and the components related thereto. Thus, the carrier 10 further comprises a canopy 30 having a top panel 32, a front panel 34, and a rear panel 36, wherein the front panel 34 and the rear panel 36 downwardly depend from the top panel 32, the canopy 30 complementing the first sidewall 26 and the second sidewall 28 and defining an enclosure for the reel 18 and related components. It is envisioned that the canopy 30 may be hinged or otherwise attached to the pallet 11 via platform 12. Moreover, it is also envisioned that the canopy 30 may be controlled by the control panel 38 via motor 22 (consistent with the disclosures herewith) to fully automate the opening and closing of the canopy 30 in cooperation with the remainder of the carrier 10 apparatus described herein.

Likewise, the other constituent parts or components of the carrier 10, including first sidewall 26 and second sidewall 28, the canopy 30 (and its components, top panel 32, front panel 34, and rear panel 36) may be manufactured from similarly durable materials, such as metal, alloys, plastic, and the like, and combinations of these materials.

The carrier 10 may also include a control panel 38. It is envisioned that the control panel 38 may include a variety of controls, including power (on/off); forward and backward rotation, including variable speed rotation; elevation and return; braking; and other associated controls for controlling the carrier 10 apparatus. It is envisioned that the control panel 38 is operably coupled with the motor 22 for specifically controlling on-loading (e.g., take-up) and off-loading (e.g., pay-off) of rolled product onto and/or from a reel 18 and/or drum 20 housed within the carrier 10, as well as controlling the locomotion and/or direction of one or more wheels 24 consistent with the disclosure provided above. It is further envisioned that the control panel 28 may also control the collapsible and/or deployable positioning of the sidewalls 26, 28 relative to the pallet 11 for storage and/or deployment as necessitated.

Figure 3:
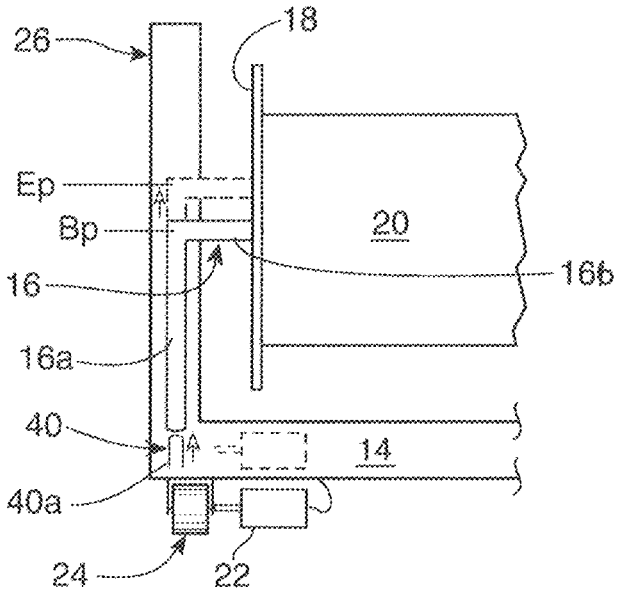
FIG. 3 is an exploded sectional view of a sidewall with elevation means.

More particularly, as related to elevation and return controls, it is envisioned that the carrier 10 may include elevation means 40 disposed within the pallet 11. Elevation means 40 supports the shaft 16 and is adjustable between a base position Bp and an elevated position Ep. As depicted in FIG. 3, it is envisioned that elevation means 40 may comprise a variety of components and/or elements, including as shown a piston or linkage 40*a* for advancing and urging the shaft post 16*a* from a base or starting position (Bp) to an elevated position (Ep) and then returned to the base or starting position (Bp) when the piston or linkage advance is removed and/or returned to a non-advanced/retracted position. By urging the shaft post 16*a*, the shaft arm 16*b* is also urged from a base or starting position (Bp) to an elevated position (Ep) and returned when removed or reversed.

Consistent with FIGS. 5*a* and 5*b*, the apparatus 10 may include one or more recesses 90 in the body of the walls or sidewalls. Each recess 90 may include one or more functions, including the utilization of locks or locking devices to secure the rolled product contents that may be disposed within the apparatus 10 and/or system. The apparatus 10 and/or system may include a digital tracking system 100 that allows a party or parties to track the location and transportation of a reel container apparatus 10 and improve the security of any rolled product transported for delivery.

The recesses 90 may also include voids or eyelets or hasps for connecting with machinery. For example, a crane or other device with an arm and hook for lifting and moving heavy objects might be connected to the apparatus 10 via one of the recesses 90 by using the void left or any eyelet or hasp inserted therewith or therethrough.

The features described herewith provide several advantages not previously disclosed or known with rolled product take-up, transport, and pay-off apparatus(es) and/or system (s). For example, a carrier consistent with the description herewith is not known to have an automated take-up and pay-off mechanism in conjunction with an automated locomotion control mechanism, especially controlled by a motor that responds to a control or control panel input. Moreover, an apparatus or system is not known that includes a protective canopy to minimize and/or inhibit damage to the rolled product during on-loading, transport, off-loading, and installation preparation. Furthermore, an apparatus or system is not known that includes a multi-position sidewall and/or sidewalls that may be deployed and/or collapsed for storage.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A reel carrier for a rolled product, the reel carrier comprising:

a pallet having a platform bound by a frame, the pallet supporting a shaft rotatable in a forward and reverse direction, the pallet having at least one sidewall upwardly depending from the frame;

an adjustable step depending from the platform;

a reel supported on the shaft and rotatable about the shaft in a forward and a reverse direction, the reel configured to take-up the rolled product thereon to subsequently pay-off the rolled product from the top-side of the reel in an over-the-top delivery to optimize the structural integrity of the rolled product and minimize the structural stress of the rolled product;

a motor operably coupled to cause rotation of the shaft supporting the reel; and a charging system for recharging one or more batteries operatively coupled to the motor.

2. The carrier of claim 1 further comprising a control panel operably coupled with the motor.

3. The carrier of claim 1 further comprising a plurality of wheels depending from the pallet.

4. The carrier of claim 3, wherein the motor is operably coupled to at least one of the plurality of wheels via wheel articulation means.

5. The carrier of claim 1 further comprising a window formed in the at least one sidewall.

6. The carrier of claim 1 further comprising a canopy, wherein the canopy complements the at least one sidewall and defines an enclosure for the reel supported on the shaft.

7. The carrier of claim 1 further comprising means for elevating the shaft between a base position and an elevated position, wherein the elevation means is configured and adapted for placement within the pallet.

8. The carrier of claim 1 further comprising at least one recess formed in the at least one sidewall.

9. The carrier of claim 1 further comprising a tracking system.

10. The carrier of claim 1 further comprising a leveling armature for winding rolled product.

11. The carrier of claim 1 further comprising a measuring device for measuring the length of the rolled product on-loaded and payed-off from the reel.

12. A reel carrier for a rolled product, the reel carrier comprising:

a pallet having a platform bound by a frame, the pallet supporting a shaft rotatable in a forward and reverse direction, the pallet having at least one sidewall upwardly depending from the frame;

a reel supported on the shaft and rotatable about the shaft in a forward and a reverse direction, the reel configured to take-up the rolled product thereon to subsequently pay-off the rolled product from the top-side of the reel in an over-the-top delivery to optimize the structural integrity of the rolled product and minimize the structural stress of the rolled product;

a second small inner reel;

a motor operably coupled to cause rotation of the shaft supporting the reel; and a charging system for recharging one or more batteries operatively coupled to the motor.

13. A reel carrier for a rolled product, the reel carrier comprising:

a pallet having a platform bound by a frame, the pallet supporting a shaft rotatable in a forward and reverse direction, the pallet having a plurality of sidewalls upwardly depending from the frame;

an adjustable step depending from the platform;

a reel supported on the shaft and rotatable about the shaft in a forward and a reverse direction, the reel configured to take-up the rolled product thereon to subsequently pay-off the rolled product from the top-side of the reel in an over-the-top delivery to optimize the structural integrity of the rolled product and minimize the structural stress of the rolled product;

a motor operably coupled to cause rotation of the shaft supporting the reel; and a charging system for recharging one or more batteries operatively coupled to the motor.

14. The carrier of claim 13 further comprising a control panel operably coupled with the motor.

15. The carrier of claim 13 further comprising a second small inner reel.

16. The carrier of claim 13 further comprising a canopy, wherein the canopy complements the at least one sidewall and defines an enclosure for the reel supported on the shaft.

17. The carrier of claim 13 further comprising a window formed in the at least one sidewall.

* * * * *